United States Patent [19]

Lutus et al.

[11] Patent Number: 4,538,900

[45] Date of Patent: Sep. 3, 1985

[54] ELECTROPHOTOGRAPHIC COPYING APPARATUS INCLUDING DRUM CONDITIONING APPARATUS AND METHOD

[75] Inventors: Arthur C. Lutus, Redwood City; Victor B. van Blerk, San Jose, both of Calif.

[73] Assignee: Ricoh Company, Ltd., Tokyo, Japan

[21] Appl. No.: 550,113

[22] Filed: Nov. 9, 1983

[51] Int. Cl.[3] ..... G03G 15/00

[52] U.S. Cl. ..... 355/14 CH; 355/3 CH; 355/14 E; 355/15; 118/652

[58] Field of Search ..... 355/14 CH, 3 CH, 15, 355/3 DD, 14 D, 3 R, 4, 14 E; 118/652, 645

[56] References Cited

U.S. PATENT DOCUMENTS

| | | | |
|---|---|---|---|
| 3,649,262 | 3/1972 | Cade et al. | 355/15 X |
| 3,778,148 | 12/1973 | Fujitsuka et al. | 355/15 |
| 3,838,921 | 10/1974 | Sargis | 355/15 |
| 4,017,170 | 4/1977 | Komori et al. | 355/3 R |
| 4,244,647 | 1/1981 | Fujiwara et al. | 355/14 R |

*Primary Examiner*—A. C. Prescott

*Attorney, Agent, or Firm*—Flehr, Hohbach, Test, Albritton & Herbert

[57] ABSTRACT

This apparatus relates particularly to apparatus and method for conditioning and pre-fatiguing a photoconductive drum in an electrophotographic copying apparatus. In a preferred embodiment, a two color LED is located adjacent the photoconductive surface. The color of the emissions from these two-color LED's is controlled through the polarity of the voltage applied to the terminals; that is, reversal of the polarity of the voltage applied reverses the color displayed. Therefore, in a preferred embodiment of the present invention, means are provided for supplying an AC driving current to the LED which would inherently result in a synchronous high speed flashing of the red/green light. By combining this AC source with a controllable DC bias, it is possible to provide a drum discharge and preconditioning light which is an all red light; an all green light; or which has controllable percentages of red and green in each duty cycle. In an optimum conditioning cycle, when the machine is first turned on a maximum of two cycles of all red light are utilized to build in fatigue; it is thereafter desirable during extended use of the machine to use only green, which will reduce the light fatigue effect on the photoconductive surface. By an appropriate timing circuit, a controllable shift from all red at the beginning of use of the machine through a combined duty cycle combining both red and green to an all green light can be accomplished.

12 Claims, 1 Drawing Figure

Figure 1:
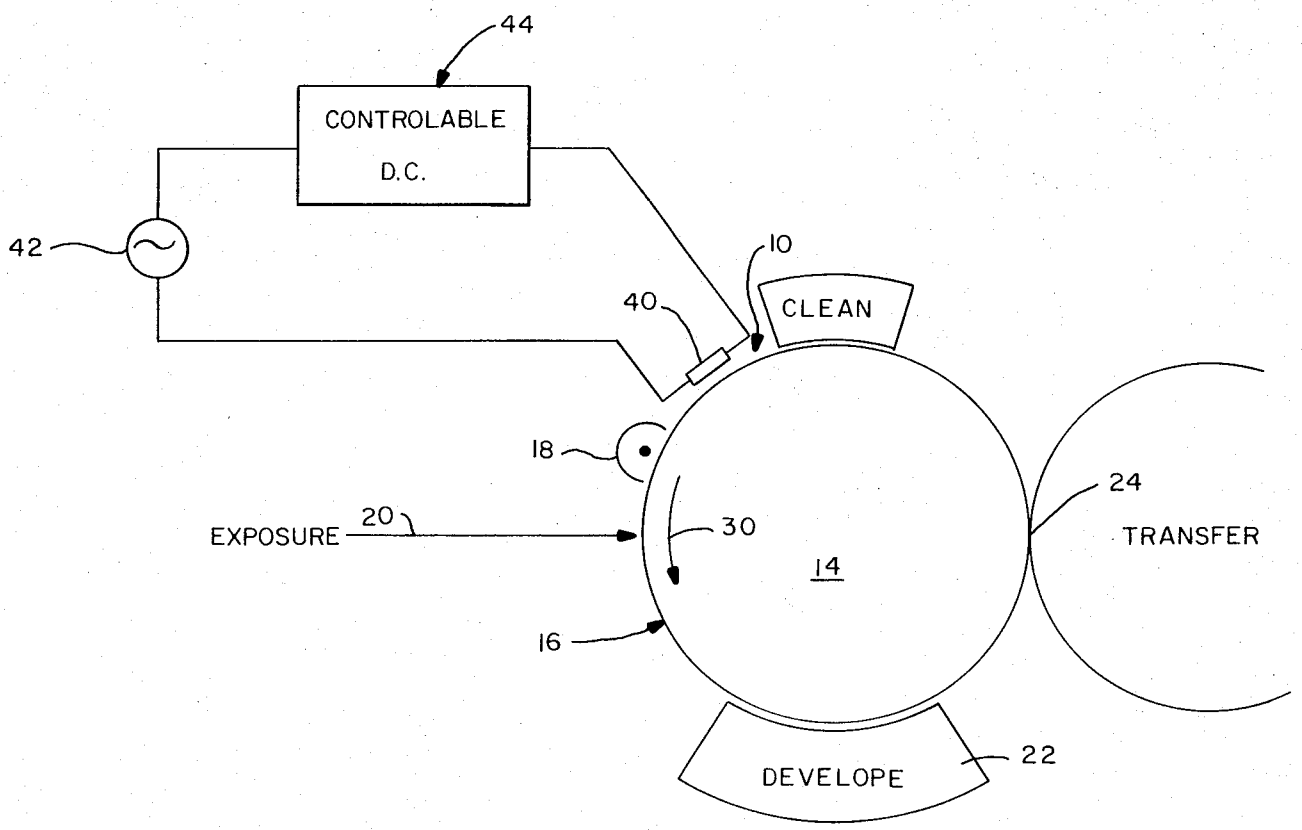

ELECTROPHOTOGRAPHIC COPYING APPARATUS INCLUDING DRUM CONDITIONING APPARATUS AND METHOD

The present invention relates generally to electrophotographic copying apparatus in which electrically charged toner of one polarity is transferred from an oppositely charged electrostatic image on the outer surface of the photoconductive drum to the front side of a blank sheet for transforming the latter into an intended copy as the back side of the sheet engages the outer surface of the transfer roll positioned to adjacent the drum. This apparatus relates particularly to apparatus and method for conditioning and pre-fatiguing the photoconductive drum.

The present invention is especially suitable for use in a typical electrophotographic apparatus which is presently being used in the industry. This typical apparatus includes a rotatable drum having a photosensitive outer circumferential surface, and means for rotating the drum in a controlled fashion so that its outer circumferential surface defines a fixed annular path of movement. The apparatus produces copies from a given master by first forming an electrostatic image corresponding to the particular information to be copied on the photosensitive outer circumferential surface of the drum. Thereafter, the latent image is developed by means of the toner particles, specifically electrically charged heat fusible particles, which are applied to the image bearing surface in a specific way. Finally, the applied toner particles are transferred from the drum to the blank sheet and thereafter fused thereon for transforming the sheet into a permanent copy.

After the toner transfer step the drum must be cleaned so that no trace of the electrical image, either as represented by toner particles or static electric charges, remains.

The toner particles are removed by brushes or scrapers. Removal of the static charges which represented the image presents a more difficult problem. In photocopiers of this type, $A_2Se_3$ photoconductors have come into common use, because of their ability to retain an image while more than one copy is made. However it has become apparent that this material also is subject to "fatigue". The fatigue problem is especially noticeable in systems using incandescent lamps, which emit significant amounts of light in the red spectrum. Fatigue manifests itself in two ways:

1. The first way is that charge builds up on the drum so that the light and dark areas of the original are not accurately reproduced;

2. Second, charge will not hold on the drum; that is after the drum is fully charged and then exposed to the image which is to be copied, the charge leaks off the surface before the latent image can be developed.

A corollary problem is that some fatique is inherent in the system in the course of a day. The result is that a system will run differently over a full operating period, producing lighter or darker copies later in the day than at the beginning of the day when the machine is turned on and has not been exposed to any charging and discharging particles for some period of time.

Prior workers in this field discovered that it is possible to build in some fatigue by shining a red or green light on the surface of the drum. At this present time, two discharge lamps, one red and one green, are employed in photocopiers of this type. These lamps are electroluminescent panels which use a relatively large area comprising about 1 inch to $1\frac{1}{2}$ inch of drum circumference for each of the lamps. This is a significant usage of space in compact photocopiers such as are presently used in the industry. Further, such electroluminescent panels operate at comparatively high voltages, and therefore require special switching circuits to time the length of exposure, and the strength of such exposure.

It is an objective of the present invention to reduce the space requirements of these red/green conditioning lights. It is a further objective of the present invention to provide a simpler means for controlling the use of such lamps.

It is yet another desirable objective of this invention to provide easily adjustable means for altering the sequence of lighting these lamps, and the duration for which each light source shall be energized.

In a preferred embodiment of this invention, a two color LED such as is presently available in the market place, is inserted in place of the two discrete red and green discharge lamps. The color of the emissions from these two-color LED's is controlled through the polarity of the voltage applied to the terminals; that is, reversal of the polarity of the voltage applied reverses the color displayed. Therefore, in a preferred embodiment of the present invention, means are provided for supplying an AC driving current to the LED which would inherently result in a synchronous high speed flashing of the red/green light. By combining this AC source with a controllable DC bias, it has been found that it is possible to provide through this very simple circuitry a drum discharge and preconditioning light which is an all red light; an all green light; or which has controllable percentages of red and green in each duty cycle.

It has further been found through testing of this system that is is desirable when the machine is first turned on to use a maximum of two cycles of all red light to build in fatigue; it is thereafter desirable during extended use of the machine to use only green, which will reduce the light fatigue effects on the photoconductive surface. By an appropriate timing circuit, a controllable shift from all red at the beginning of use of the machine through a combined duty cycle combining both red and green to an all green light can be accomplished while utilizing only very simple circuitry. Further, this light source can be contained in only $\frac{3}{4}$ of an inch of drum circumference, resulting in a very significant space saving in the design of compact copiers.

The apparatus which achieves the objectives and provides the features recited above will be described in more detail hereafter in conjunction with the drawing wherein the FIGURE is a cross-sectional view of a photoconductive drum and the relevant stations incorporated in a photocopier designed in accordance with the present invention.

The FIGURE illustrates part of an electrophotographic copying apparatus and specifically the conditioning station 10 designed in accordance with this invention. The apparatus includes a rotatable photoconductive drum 14 made of an arsenic-selenium photoconductor ($As_2Se_3$) which is known to have a bad fatiguing property. To put the location of the conditioning station 10 of this invention in perspective, it can be seen that the outer photoconductive surface 16 of drum 14 is rotated along a fixed annular path through a charging station 18 which follows the conditioning station 10; an exposure station 20 where the latent image is formed, a developing station 22 and transfer station 24, followed by cleansing station 26. In operation of the copying apparatus, photoconductive drum 14 rotates in the direction of arrow 30 to carry a segment of the drum's outer surface 16 through the charging station 18 to charge a segment of the surface to the desired voltage level (preferably about +700 volts). Thereafter the charged segment is moved through the exposure station 20 where a like image of an original or master is projected onto the moving drum 14 portions of its charged surface are discharged to thereby form an electrostatic image conforming to the original as represented by various voltage levels up to a maximum 600 volts. The various shades of white through black are represented by the voltage levels of some minimum positive voltage through +600 volts. Because of these graduated voltage levels, it is very important that prior background charges not be retained by the drum, as this would result in darker patches, shadows or ghosts showing up from previous exposure if the drum cannot be properly discharged across the various voltage levels ranging from 700 volts down through a minimum voltage corresponding to the image to be developed.

The electrostatic image thus formed is then moved through the developing station 22 which contains a suitable arrangement including a supply of heat fusible toner charged to a polarity opposite that of the latent image. In this example, the toner has a negative polarity; as the image bearing drum surface moves through the developing station, the charged toner is applied thereto causing it to develop the image. Obviously, the more highly charged portions of the surface attract more of the toner; this reemphasizes the necessity of being able to completely discharge surfaces which are only supposed to be white or light gray to avoid background discoloration. Immediately after the latent image on the drum has been developed, it is moved to transfer station 24 where the image transfer from photoconductive drum 18 to paper (not shown) will occur within the transfer nip. Following movement through the transfer nip, the surface of the drum passes through a cleaning station 26 where the remaining toner is to be cleaned from the surface, by a brush or wiper. After the cleaning of the toner from the drum, obviously some of the electrostatic representation of the image remains. The surface of the drum is therefore rotated through the conditioning station 10.

At the conditioning station 10 in accordance with this invention, a two-color LED 40 is provided adjacent the surface of the drum. This device which is of a commercially available type has a red output when the current is flowing in one way and a green output when the polarity current is reversed. Therefore, if simply an AC source is provided connected to the two terminals of the two-color LED, then the LED will switch colors at a rate synchronous with the frequency of the AC source.

However, it has been found that it is highly desirable to use a red light alone to condition the drum when the system is first put into use or has been standing without use for some period of time. This prefatiguing conditions the drum so that the copies are of consistent quality throughout the day. It has further been found that in the course of long repeated use, that a green light emphasis is desirable to reduce the light fatigue of the drum, that is the increased presence of a non-discharged background image.

The prefatiguing does not become readily apparent to a person who views the copies as the fatiguing having been imposed by a red light shining over the full surface of the drum raises slightly the entire background charge on the surface of the drum. It has been found that it is preferable to use one cycle or a maximum of two cycles of the entire drum past a red light to build in this background fatigue level. Thereafter, the change in the fatiguing light to reduce the amount of fatigue on the drum may be to a green light alone, or may constitute an emphasis on a green light. All of these can be accomplished by a change in a controllable DC bias 44 which is provided in accordance with known electrical circuit design principles so that the DC bias is variable between a +V and a −V, the voltage V provided by the controllable DC circuit being greater than the AC voltage provided by AC source 44. In this way, by using a DC bias on the AC current, a mixture of red or green light can be obtained; by providing a maximum +V DC bias added to the standard AC energizing current, one terminal of the LED will always be positive with respect to the other so that only one color is obtained; by providing a negative DC bias greater than the magnitude of the AC voltage, only the opposite terminal of the LED is energized whereby only the other color is displayed or emitted.

Therefore, by the adaptation of a single red/green LED for use in a electrophotographic apparatus; and by use of this LED in combination with a power supply comprising a steady AC current and a controllable DC bias, a highly controllable light source is provided for prefatiguing a drum at the initiation of operation and for reducing the fatiguing of the drum in the course of the day's operation. By using a controllable DC bias on the AC current, a very simple circuit is provided which is adaptable to different operating conditions, different type of photoconductive surfaces, and different types and thicknesses of photoconductor. Adjustment can even be made to allow for aging and other problems with photoconductor surface.

Modifications of the preferred embodiment disclosed herein may become apparent to one of skill in the art who has studied this invention disclosure. Therefore, the scope of the subject invention is to be limited only by the appended claims.

What is claimed is:

1. Conditioning apparatus for establishing or removing background charge levels on a photoconductive recording surface in preparing said surface for reuse in an electrophotographic copying system, comprising a single light discharge means for selectively emitting red or green light; and a single power supply connected to said light discharge means and variable between two different output signals, said first signal level causing discharge of red light only and a second signal causing discharge of green light only.

2. Apparatus according to claim 1 wherein said single power supply provides said first signal at a first polarity and said second signal at an opposite polarity.

3. Apparatus according to claim 1 wherein said single power supply comprises an AC signal source and a DC signal source, whereby the level of said DC signal controls the relative length of time of emission of red and green light.

4. Apparatus according to claim 1 wherein said light discharge means comprises a single LED responsive to direction of current flow between its terminals to selectively emit red or green light.

5. Apparatus according to claim 4 wherein said single power supply comprises an AC signal source and a DC signal source, whereby the level of said DC signal controls the relative emission of red and green light.

6. In an automatic electrophotographic copying machine in which photoconductive drum surface is moved past a series of stations including a charging station at which at least a portion of the surface is given a uniform electrostatic charge and an exposure station in which the charged surface portion is selectively discharged to represent a latent image in shades of white through black, an improvement for preconditioning the drum surface to provide consistent contrast in copies made by said copying machine, comprising light emitting means positioned adjacent said drum in advance of said charging station capable of selectively emitting red light or green light in response to control signals of a first or second polarity, said red light preconditioning said drum to controllably induce fatigue, said green light conditioning said drum to reduce fatigue on said drum, and single control means coupled to said light emitting means for selectively providing signals of said first and second polarity to said light emitting means to control emission of said red or green light.

7. Apparatus according to claim 6 wherein said light emitting means comprise a single LED responsive to signals of a first polarity to emit red light and signals of a second polarity to emit green light.

8. Apparatus according to claim 7 wherein said control means comprise a source of alternating current and a source of direct current, said alternating current providing an alternating output of red and green light, said direct current source being capable of providing current in both first and second directions to control the total emission of said red and green light.

9. Apparatus according to claim 8 wherein said photoconductive surface comprises $As_2Se_3$.

10. A method of conditioning the surface of a photoconductive drum in an electrophotographic copying system wherein a single source of red and green light comprising a red/green LED is positioned adjacent said photoconductive drum and responds to signals of a first polarity to emit red light and signals of a second polarity to emit green light, and comprising the steps of supplying alternating current to said light source to cause alternate emission of red and green light, and selectively applying a further direct current of a first polarity to cause emission of a higher percentage of red light of the total light emitted, or a direct current of a second polarity to cause emission of a higher percentage of green light of the total light emitted.

11. The method of preconditioning a drum according to claim 10 wherein for the first complete rotation of said drum sufficient direct current of a first polarity is supplied to cause emission of only red light.

12. The method of preconditioning a drum according to claim 11 wherein for later rotation cycle of said drum sufficient direct current is supplied to cause emission of only green light.

* * * * *